US011298910B2

(12) United States Patent
Tabuchi et al.

(10) Patent No.: US 11,298,910 B2
(45) Date of Patent: Apr. 12, 2022

(54) SHEET FOLDING APPARATUS

(71) Applicant: Horizon International Inc., Shiga (JP)

(72) Inventors: Hideaki Tabuchi, Shiga (JP); Hiroki Yamamoto, Shiga (JP); Shigeru Wakimoto, Shiga (JP); Yoshikazu Nakamura, Shiga (JP)

(73) Assignee: HORIZON INTERNATONAL INC., Shiga (JP)

( * ) Notice: Subject to any disclaimer, the term of this patent is extended or adjusted under 35 U.S.C. 154(b) by 243 days.

(21) Appl. No.: 16/492,990

(22) PCT Filed: Apr. 25, 2017

(86) PCT No.: PCT/JP2017/016340
§ 371 (c)(1),
(2) Date: Sep. 11, 2019

(87) PCT Pub. No.: WO2018/198187
PCT Pub. Date: Nov. 1, 2018

(65) Prior Publication Data

US 2020/0039171 A1 Feb. 6, 2020

(51) Int. Cl.
*B65H 45/16* (2006.01)
*B31F 1/00* (2006.01)
*B65H 9/00* (2006.01)

(52) U.S. Cl.
CPC ..... *B31F 1/0019* (2013.01); *B65H 9/00* (2013.01); *B65H 45/16* (2013.01)

(58) Field of Classification Search
None
See application file for complete search history.

(56) References Cited

U.S. PATENT DOCUMENTS 7,467,793 B2 * 12/2008 Tanabe ..... B65H 5/062 271/227
7,534,201 B2 * 5/2009 Yamamoto ..... B65H 9/101 493/421

(Continued)

FOREIGN PATENT DOCUMENTS

CN 104340711 A 2/2015
CN 104960972 A 10/2015

(Continued)

OTHER PUBLICATIONS

Espacenet machine translation of JP2003066661A; http://translationportal.epo.org/emtp/translate/?ACTION=description-retrieval&COUNTRY=JP&ENGINE=google&FORMAT=docdb&KIND=A&LOCALE=en_EP&NUMBER=2003066661&OPS=ops.epo.org/3.2&SRCLANG=ja&TRGLANG=en (Year: 2003).*

(Continued)

*Primary Examiner* — Leslie A Nicholson, III
(74) *Attorney, Agent, or Firm* — Kirschstein, Israel, Schiffmiller & Pieroni, P.C.

(57) ABSTRACT

A sheet folding apparatus includes a sheet folding unit disposed to fold a sheet and a conveyance unit disposed to feed the sheet to the sheet folding unit in a feed direction orthogonal to a fold direction of the sheet folding unit while correcting a skew of the sheet. The conveyance unit includes an elongated reference guide, a conveyance mechanism disposed to convey the sheet in the feed direction while exerting a force on the sheet toward the reference guide, an adjustment mechanism disposed to adjust an inclination of the reference guide with respect to the feed direction. The apparatus further includes an input unit through which a user inputs a folding misalignment amount of the sheet folded by the sheet folding unit. The inclination of the reference guide is corrected by the adjustment mechanism based on at least (Continued)

the folding misalignment amount inputted through the input unit.

7 Claims, 14 Drawing Sheets

(56) References Cited

U.S. PATENT DOCUMENTS

| | | | | |
|---|---|---|---|---|
| 8,764,007 | B2 * | 7/2014 | Saito | B65H 7/08 271/228 |
| 9,751,708 | B2 * | 9/2017 | Hagihara | B65H 5/064 |
| 2007/0232474 | A1 | 10/2007 | Yamamoto | |
| 2011/0294639 | A1 | 12/2011 | Imazu et al. | |
| 2012/0220440 | A1 | 8/2012 | Murata et al. | |

FOREIGN PATENT DOCUMENTS

| | | | |
|---|---|---|---|
| DE | 1230440 | B | 12/1966 |
| JP | H10-035999 | A | 2/1998 |
| JP | 2003-066661 | | 3/2003 |
| JP | 2003-081529 | A | 3/2003 |
| JP | 2007-261726 | | 10/2007 |
| JP | 2012-121686 | | 6/2012 |
| JP | 2012-171737 | | 9/2012 |
| JP | 2012-171785 | A | 9/2012 |

OTHER PUBLICATIONS

International Search Report dated Jul. 14, 2017 in corresponding International patent application No. PCT/JP2017/016340.

"Computersteuerung Schafft Wettbewerbsvorteile" Deutscher Drucker, Deutscher Drucker Verlagsgesellschaft, Ostfildern, DE, vol. 37, No. 12, pp. 98-101.

Extended European Search Report dated Nov. 13, 2020, on corresponding European Patent Application No. 17907738.3.

Chinese Office Action (dated Aug. 4, 2020) on corresponding Chinese Patent Application No. 201780089997.4, Filed Oct. 24, 2019, Good Use International Co.,Ltd., Folding Device, pp. 1-15.

International Search Report, dated Aug. 1, 2017, on corresponding International Patent Application No. PCT/JP/2017/016340.

* cited by examiner

SHEET FOLDING APPARATUS

TECHNICAL FIELD

The present invention relates to a sheet folding apparatus that corrects a skew of a sheet and then folds the sheet.

BACKGROUND ART

Such a type of sheet folding apparatus is well known, for example, as disclosed in Patent Document 1. The sheet folding apparatus, for example, includes a sheet folding unit disposed to fold a sheet in a predetermined fold direction and a conveyance unit disposed upstream of the sheet folding unit to feed the sheet to the sheet folding unit in a feed direction orthogonal to the fold direction while correcting a skew of the sheet.

The conveyance unit includes an elongated reference guide (also referred to as an alignment ruler) extending in the feed direction and a conveyance mechanism disposed next to the reference guide to convey the sheet toward the reference guide obliquely with respect to the feed direction.

As the sheet is conveyed by the conveyance mechanism, an end of one side edge of the sheet first comes in contact with the reference guide. As the sheet is further conveyed by the conveyance mechanism, the one side edge of the sheet comes in contact with the reference guide over an entire length of the one side. Consequently, the skew of the sheet is corrected with respect to the feed direction. The sheet is then conveyed to the sheet folding unit with its skew corrected, is folded by the sheet folding unit, and is discharged by the sheet folding unit.

The reference guide has to be disposed to extend in parallel with the feed direction, that is, orthogonally to the fold direction. When the reference guide is inclined with respect to the feed direction, the skew of the sheet fails to be accurately corrected with respect to the feed direction. As a result, the sheet is folded in a misaligned manner (FIG. 12C).

To prevent such misaligned folding, the conveyance unit includes an adjustment mechanism for adjusting an inclination of the reference guide. A user causes the sheet folding apparatus to fold a sheet as a trial to check for any misalignment of the folded sheet. Then, the user operates the adjustment mechanism by operation means (e.g. a switch or a dial), thereby correcting an inclination of the reference guide with respect to the feed direction in such a manner that the reference guide is aligned with the feed direction.

However, it is difficult to check for any misalignment of the folded sheet with eyes and determine in a short time a correction amount required for correcting the inclination of the reference guide. To accurately correct the inclination, the user has to repeat trial folding of the sheet and the operation of the adjustment mechanism many times. However, this results in an increase in burden and time.

CITATION LIST

Patent Document

Patent Document 1: JP 2007-261726 A

SUMMARY OF THE INVENTION

Problem to be Solved by the Invention

It is, therefore, an object of the invention to provide a sheet folding apparatus that facilitates correcting an inclination of a reference guide.

Means for Solving Problem

According to an aspect of the present invention, there is provided a sheet folding apparatus including a sheet folding unit disposed to fold a sheet and a conveyance unit disposed to feed the sheet to the sheet folding unit in a feed direction orthogonal to a fold direction of the sheet folding unit while correcting a skew of the sheet. The conveyance unit includes an elongated reference guide, a conveyance mechanism disposed to convey the sheet in the feed direction while exerting a force on the sheet toward the reference guide, and an adjustment mechanism disposed to adjust an inclination of the reference guide with respect to the feed direction. The skew of the sheet is corrected by the reference guide and the conveyance mechanism. The sheet folding apparatus further includes an input unit through which a user inputs a folding misalignment amount of the sheet folded by the sheet folding unit. The inclination of the reference guide is corrected by the adjustment mechanism based on at least the folding misalignment amount inputted through the input unit.

The input unit may be further used by the user for inputting a folding pattern of the sheet. The inclination of the reference guide may be corrected based on at least the folding misalignment amount and the folding pattern inputted through the input unit.

The input unit may be further used by the user for inputting a size of a sheet to be folded. The inclination of the reference guide may be corrected based on at least the folding misalignment amount and the size inputted through the input unit.

A correction amount required for the reference guide to be aligned with the feed direction may be calculated based on the folding misalignment amount, a folding length of the sheet folding unit, and a size of a sheet to be folded.

The sheet folding unit may include a plurality of folding mechanisms disposed to fold the sheet once in the fold direction. The folding length may be a folding length of the folding mechanism that first fold the sheet. The folding misalignment amount may be a folding misalignment amount of the sheet folded by the folding mechanism that first folds the sheet.

The reference guide may be disposed to be rotatable around a pin extending in an vertical direction. The adjustment mechanism may adjust the inclination of the reference guide by rotating the reference guide around the pin.

The sheet folding unit may be a buckle folding machine.

Effect of the Invention

A user inputs a folding misalignment amount of a folded sheet through an input unit, thereby making it possible to correct an inclination of a reference guide with reference to a feed direction. That is, correcting an inclination of the reference guide is facilitated by means of simple input.

MODE(S) FOR CARRYING OUT THE INVENTION

Hereinafter, an embodiment of a sheet folding apparatus according to the invention will be described with reference to the drawings.

Figure 1:
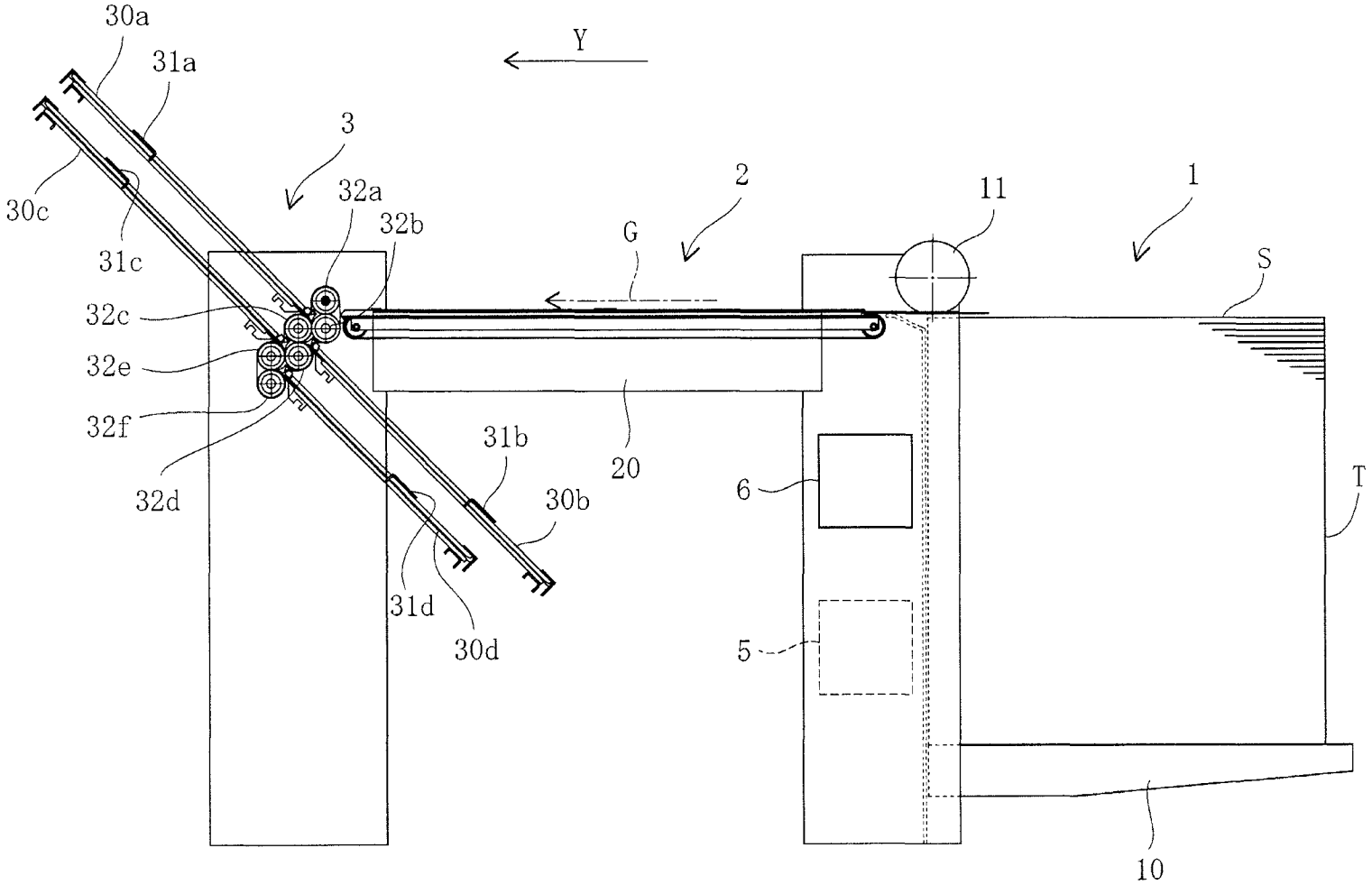
FIG. 1 is a schematic side view of a sheet folding apparatus according to an embodiment of the invention.

As illustrated in FIG. 1, the sheet folding apparatus includes a sheet feed unit 1, a conveyance unit 2, and a sheet folding unit 3. The sheet folding unit 3 is disposed to fold a sheet S in a predetermined fold direction and to discharge the folded sheet S, the sheet S being fed by the sheet feed unit 1 and the conveyance unit 2.

The sheet feed unit 1 is disposed to feed the sheet S from a sheet stack T to the conveyance unit 2. The sheet feed unit 1 includes a shelf 10 supported by the frame to be liftable and a vacuum rotor 11 supported by the frame 20 and located above a front end of the shelf 10. The sheet feed unit 1 causes the vacuum rotor 11 to suction the uppermost sheet S of the sheet stack T placed on the shelf 10 so as to feed sheets S one by one to the conveyance unit 2.

The conveyance unit 2 is disposed downstream of the sheet feed unit 1 and upstream of the sheet folding unit 3. The conveyance unit 2 is disposed to receive the sheet S fed from the sheet feed unit 1 and to feed the sheet S to the sheet folding unit 3 in a feed direction Y while correcting a skew of the sheet S. The feed direction Y of the conveyance unit 2 is orthogonal to the fold direction of the sheet folding unit 3. This means that the sheet s is fed by the conveyance unit 2 to the sheet folding unit 3 in a direction orthogonal to the fold direction. FIG. 1 illustrates a schematic configuration of the conveyance unit 2.

Figure 2:
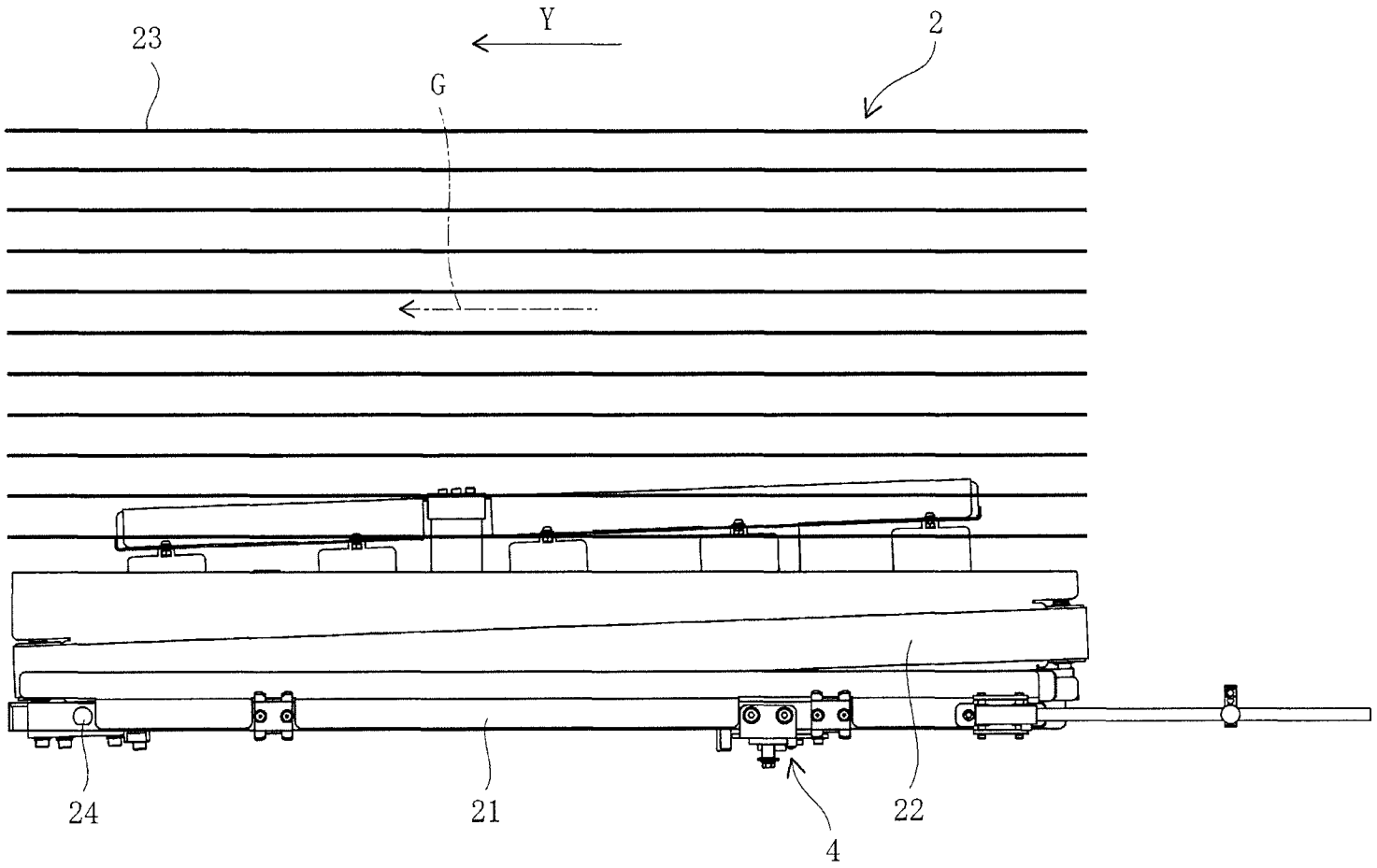
FIG. 2 is a plan view of a conveyance unit of the sheet folding apparatus in FIG. 1.
Figure 3:
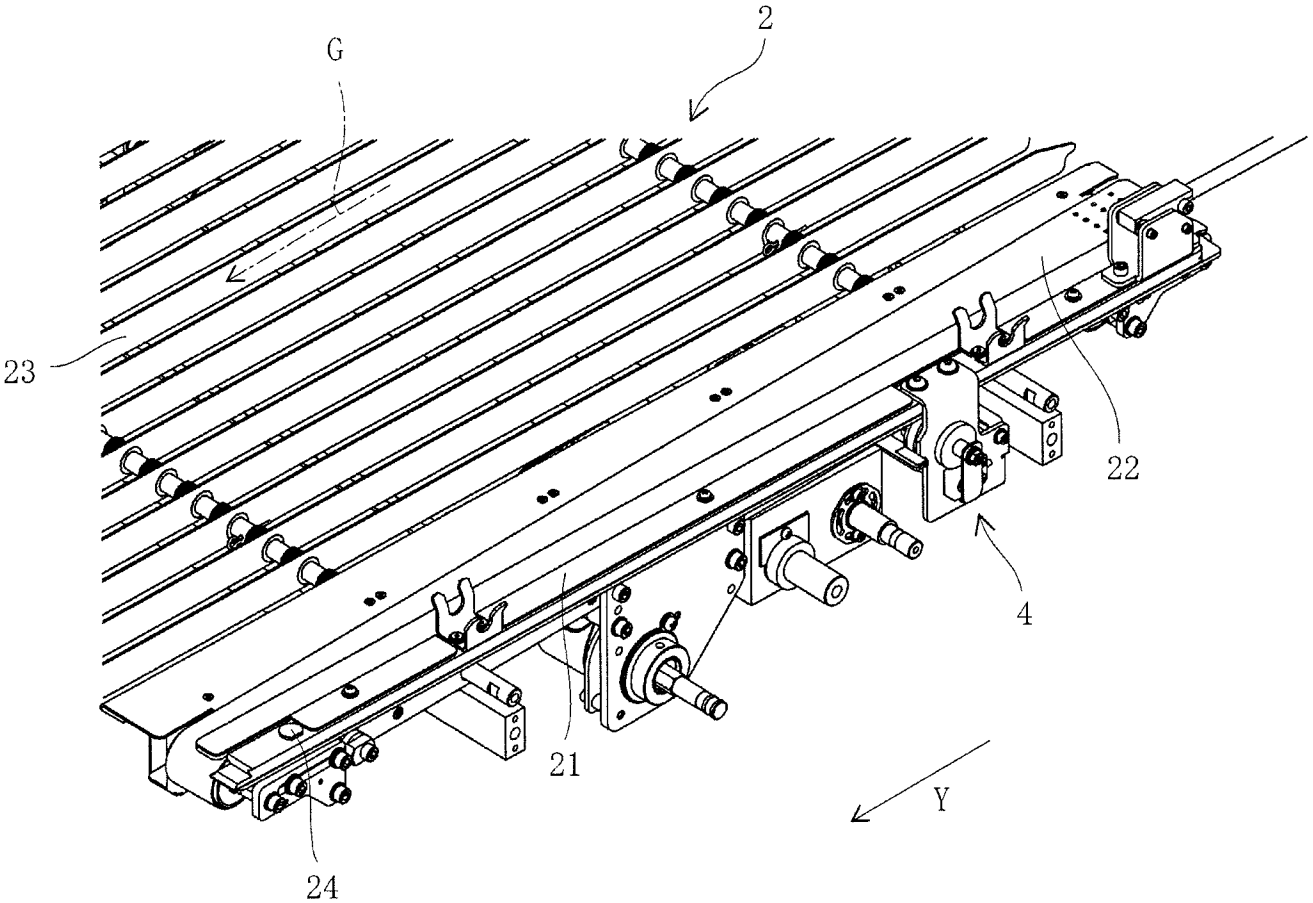
FIG. 3 is a partial perspective view of the conveyance unit in FIG. 2.

As illustrated in FIGS. 2 and 3, the conveyance unit 2 includes the flame 20 (FIG. 1) provided with a conveying path G of the sheet S. The conveyance unit 2 further includes an elongated reference guide 21 located on one side of the conveying path G to extend in the feed direction Y. The conveyance unit 2 further includes a conveyance mechanism 22 disposed adjacent to the reference guide 21 on a lower side of the conveying path G to convey the sheet S in the feed direction Y on the conveying path G while exerting a force on the sheet S toward the reference guide 21. The conveyance unit 2 further includes a support base 23 disposed adjacent to the conveyance mechanism 22 on the lower side of the conveying path G to support most of an underside of the sheet S which is being conveyed by the conveyance mechanism 22.

In the embodiment, the conveyance mechanism 22 is a conveyor extending obliquely with respect to the feed direction Y from an upstream side of the feed direction Y toward the reference guide 21. More specifically, the conveyor is a suction conveyor which conveys the sheet while suctioning the underside of the sheet S to a conveyor belt thereof. When the conveyor is driven, a conveying force thereof exerts on the sheet S in both the feed direction Y and a direction toward the reference guide 21.

Figure 4:
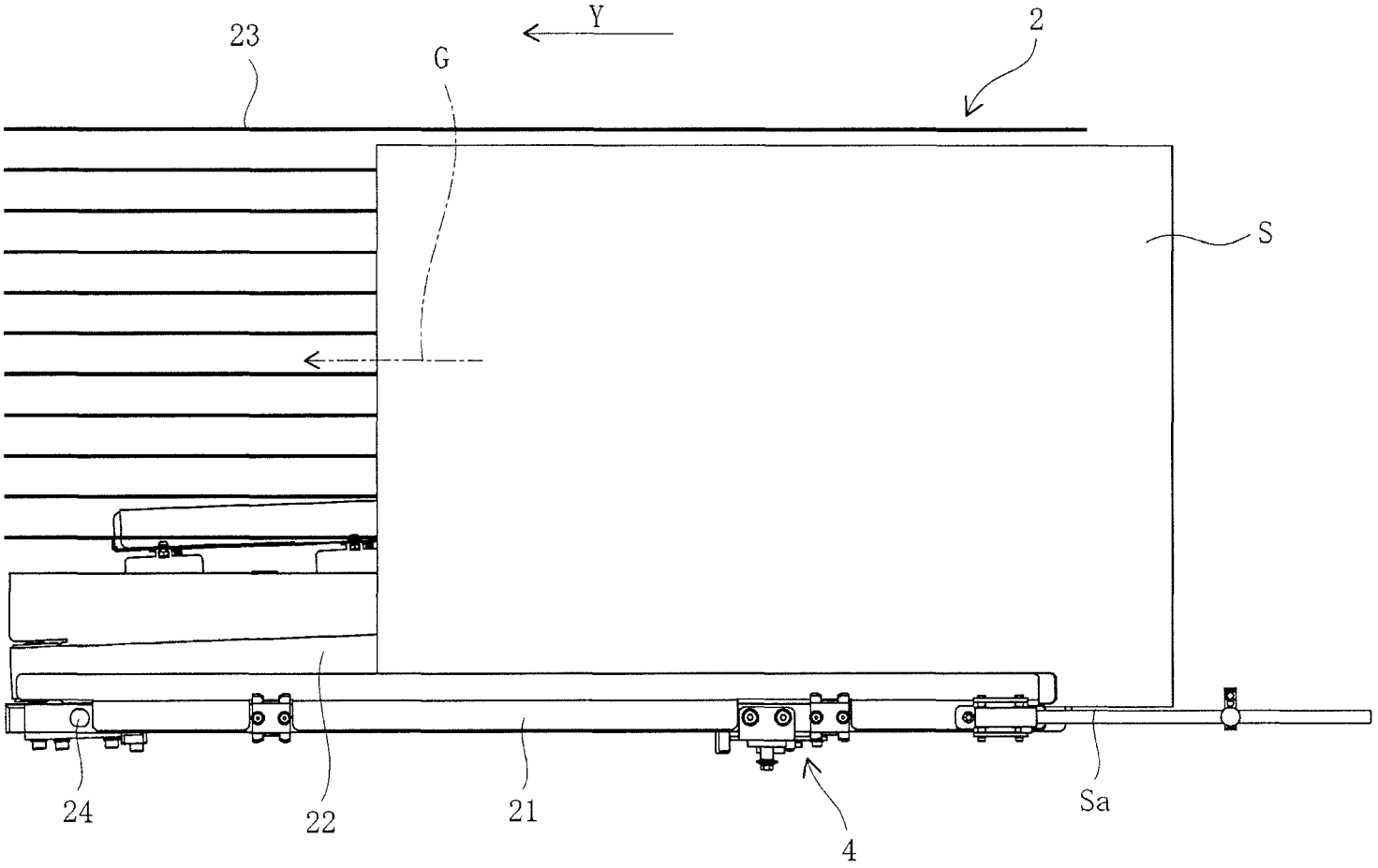
FIG. 4 is a plan view for describing correction of a skew of a sheet.

As illustrated in FIGS. 2 to 4, the sheet S that has been fed to the conveyance unit 2 is conveyed by the conveyance mechanism 22 toward the reference guide 21 obliquely with respect to the feed direction Y. Due to this, one end of one side edge Sa (FIG. 4) of the sheet S comes in contact with the reference guide 21. While the sheet S is then further conveyed in the feed direction Y, the one side edge Sa comes in contact with the reference guide 21 over an entire length of the one side edge due to a force generated by the conveyance mechanism 22 toward the reference guide 21. In this manner, a skew of the sheet S is corrected with respect to the feed direction Y by the reference guide 21 and the conveyance mechanism 22. Hence, the sheet S is conveyed to the sheet folding unit 3 with the skew thereof corrected.

As illustrated in FIG. 1, the sheet folding unit 3 is disposed downstream of the conveyance unit 2. The sheet folding unit 3 receives the sheet S fed from the conveyance unit 2 and then folds the sheet S at least once in the fold direction (orthogonal to the feed direction Y).

The sheet folding unit 3 is provided with the conveying path of the sheet S. The sheet folding unit 3 includes a plurality of folding mechanisms disposed along the conveying path. Each of the folding mechanism folds the sheet S once in the fold direction and feeds the sheet S to the next folding mechanism. In the embodiment, four folding mechanisms are provided.

More specifically, the sheet folding unit 3 is a buckle folding machine. Each of the folding mechanism has a buckle 30*a* to 30*d* into which the sheet S is inserted and a stopper 31*a* to 31*d* disposed on the buckle 30*a* to 30*d*. The buckles 30*a* to 30*d* are arranged alternately on the upper side and the lower side along the conveying path. A leading end of the sheet S introduced into the buckles 30*a* to 30*d* comes in contact with the stoppers 31*a* to 31*d*, so that the sheet S is positioned at a predetermined position. Each Position of the stoppers 31*a* to 31*d* with respect to the associated buckles 30*a* to 30*d* is automatically adjusted by an appropriate mechanism depending on, for example, a folding pattern (e.g. double folding or triple folding) of the sheet or a size of the sheet to be folded.

Each of the folding mechanisms further has a pairs of intake rollers 32*a*, 32*b*; 32*b*, 32*c*; 32*c*, 32*d*; 32*d*, 32*e* that is disposed in the vicinity of an inlet of the associated buckle 30*a* to 30*d* and rotated when driven so as to take the sheet S in the associated buckles 30*a* to 30*d*. Each of the folding mechanism further has a pair of discharge rollers 32*b*, 32*c*; 32*c*, 32*d*; 32*d*, 32*e*; 32*e*, 32*f* that is rotated when driven so as to fold a portion of the sheet S exteriorly protruding from the associated buckle 30*a* to 30*d* when the sheet S has been inserted into the associated buckle 30*a* to 30*d*. As obvious from FIG. 1, the discharge roller of the previous buckle simultaneously serves as the intake roller of the next buckle.

The sheet S is sequentially inserted into the buckles 30*a* to 30*d*, so that the sheet S is mountain-folded and valley-folded alternately. Namely, the sheet S fed from the conveyance unit 2 is caught and pulled between the pair of rollers 32*a* and 32*b*, and then, the leading end of the sheet S is inserted into the buckle 30*a*. The leading end of the sheet S comes in contact with the stopper 31*a*, and then, the sheet S is bent in the vicinity of the inlet of the buckle 30*a*. The bent portion is caught and pulled between the pair of rollers 32*b* and 32*c*, so that the sheet S is folded to one side.

The folded sheet S is folded to an opposite side of the previous side in the same manner by the buckle 30*b*, the pair of rollers 32*b* and 32*c*, and the pair of rollers 32*c* and 32*d*. Subsequently, the sheet S is folded on an opposite side of the previous side by the buckle 30*c*, the pair of rollers 32*c* and 32*d*, and the pair of rollers 32*d* and 32*e*. The sheet S is then folded on an opposite side of the previous side by the buckle 30*d*, the pair of rollers 32*d* and 32*e*, and the pair of rollers 32*e* and 32*f*. In this way, the sheet S is folded in an accordion manner and is then discharged from the sheet folding unit 3.

Each of the folding mechanisms further has a gate provided to the buckle 30*a* to 30*d* thereof so as to open and close the inlet of the associated buckle 30*a* to 30*d*. When the inlet of the buckle is closed by the gate, the sheet S is not folded by the buckle and is fed to the next buckle. It is, therefore, possible to select the buckles 30*a* to 30*d* to be used, that is, folding times, in accordance with a folding pattern.

Such a configuration described above enables the sheet folding unit 3 to fold the sheets S having different sizes in different folding patterns.

Figure 12A:
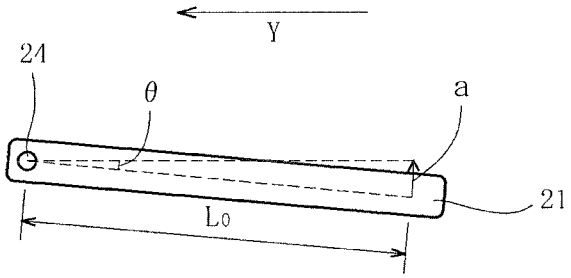
FIGS. 12A to 12C are illustration diagrams for describing correction of an inclination of a reference guide.

In the sheet folding apparatus, when the reference guide 21 is inclined with respect to the feed direction Y, the skew of the sheet S fails to be accurately corrected with respect to the feed direction Y. As a result, the folded sheet S has misalignment as illustrated in FIG. 12C. Therefore, the reference guide 21 has to extend in parallel with the feed direction Y, which means that it has to be aligned with the feed direction Y. In other words, the reference guide 21 has to extend orthogonally to the fold direction of the sheet folding unit 3. In view of this, the sheet folding apparatus according to the invention has a function of correcting an inclination of the reference guide 21 with respect to the feed direction Y.

Figure 5:
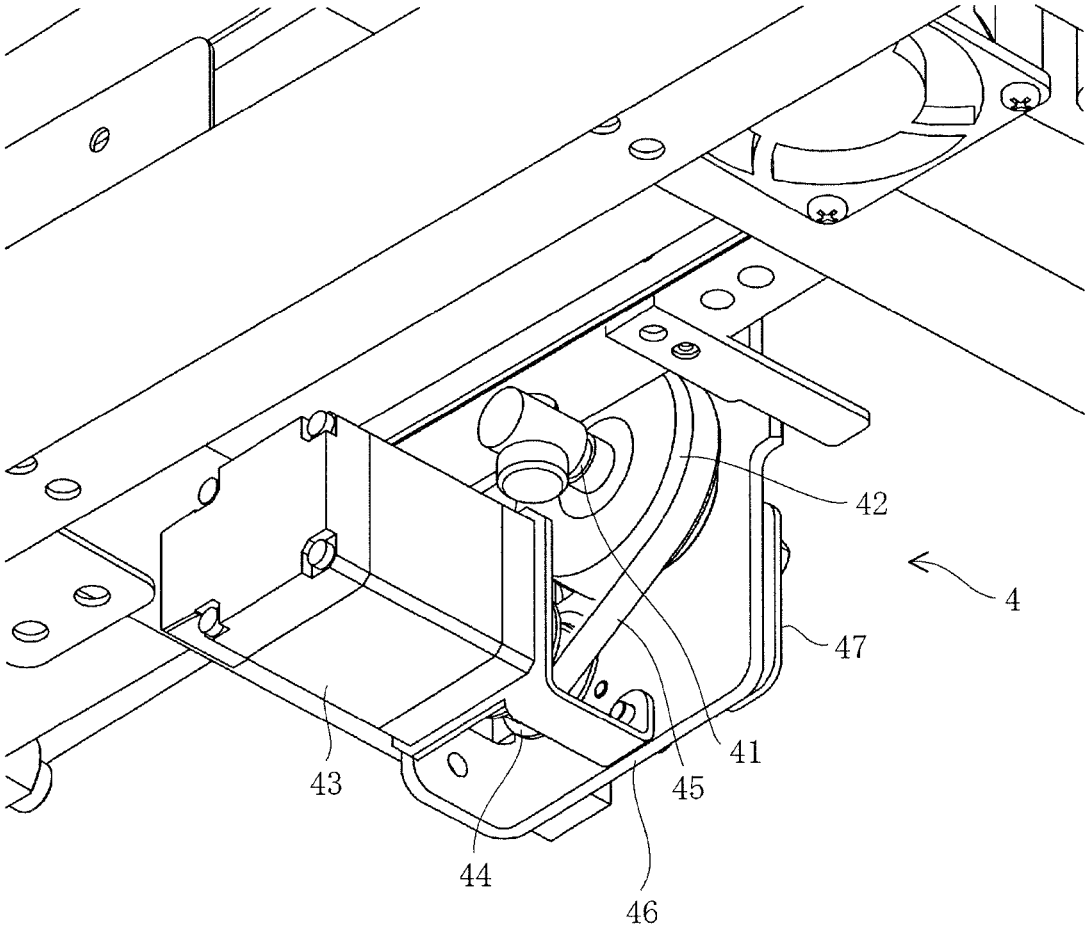
FIG. 5 is a perspective view of an adjustment mechanism of the conveyance unit in FIG. 2.

As illustrated in FIGS. 3 to 5, the conveyance unit 2 includes a pin 24 inserted into the reference guide 21 within an area of an downstream portion of the reference guide 21 and extending in the vertical direction. The reference guide 21 is attached to the frame 20 to be rotatable around the pin 24. The conveyance unit 2 includes an adjustment mechanism 4 disposed below an upstream portion of the reference guide 21 to adjust the inclination of the reference guide 21 with respect to the feed direction Y by rotating the reference guide 21 around the pin 24.

Figure 6:
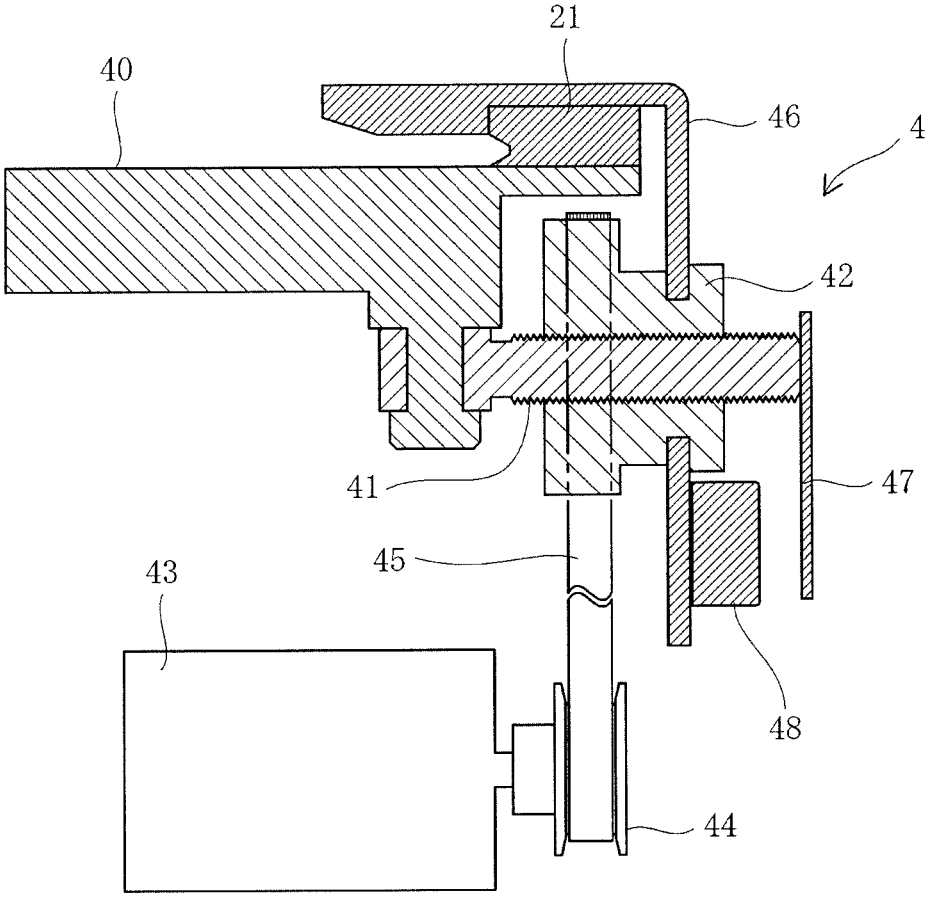
FIG. 6 is a longitudinal sectional view of the adjustment mechanism in FIG. 5.

As shown in FIGS. 5 and 6, the adjustment mechanism 4 includes a bracket 40 (FIG. 6) attached to the frame 20, an adjustment screw 41 fixed to the bracket 40 to extend orthogonally to the feed direction Y, a nut 42 screwed with the adjustment screw 41, and a motor 43 that moves the nut 42 along the adjustment screw 41 so as to rotate the reference guide 21.

In order to transmit a drive force of the motor 43 to the nut 42, the adjustment mechanism 4 includes a pulley 44 connected to an output shaft of the motor 43, and a belt 45 extending between the pulley 44 and the nut 42.

The reference guide 21, the nut 42, and the motor 43 are attached to each other by an attaching body 46 to be movable together. The reference guide 21 is not attached to the bracket 40 but is just placed on the bracket 40.

In order to detect that the reference guide 21 is located at a reference position, the adjustment mechanism 4 includes a detection body 47 attached to the adjustment screw 41, and an origin sensor 48 attached to the nut 42 and opposed to the detection body 47 to detect a distance therefrom to the detection body 47.

When the motor 43 is driven, the drive force thereof is transmitted to the nut 42 to rotate the nut 42 around the adjustment screw 41. The nut 42 moves along the adjustment screw 41 while rotating due to screwing between the adjustment screw 41 and the nut 42. The reference guide 21 and the motor 43 also move together with the nut 42 due to attachment by the attaching body 46. As described above, the reference guide 21 is rotatable around the pin 24. Therefore, when the nut 42 moves long the adjustment screw 41, the reference guide 21 is rotated around the pin 24 and thereby the inclination thereof is adjusted. A rotating direction of the reference guide 21 is determined depending on a rotating direction of the motor 43.

As illustrated in FIG. 1, the sheet folding apparatus further includes a control unit 5 and an input unit 6.

The control unit 5 is, for example, configured of a processor, a storage medium and so forth. The control unit 5 is electrically connected to the sheet feed unit 1, the conveyance unit 2, the sheet folding unit 3, and the input unit 6 to control the units 2, 3, and 6.

Figure 7:
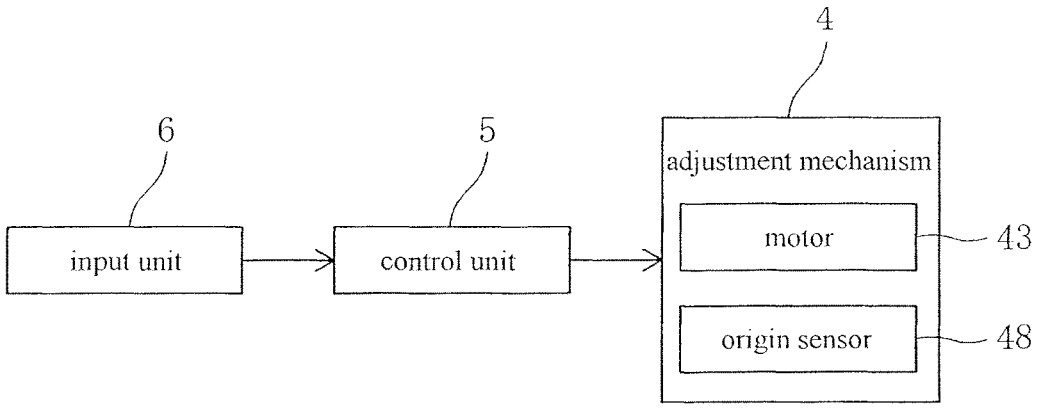
FIG. 7 is a partial block diagram illustrating the sheet folding apparatus in FIG. 1.

As illustrated in FIG. 7, in order to correct the inclination of the reference guide 21, the control unit 5 is electrically connected to the adjustment mechanism 4 (the motor 43 and the origin sensor 48 thereof) to control the adjustment mechanism 4 based on information inputted through the input unit 6. In addition, the control unit 5 serves as a calculation part configured to calculate a correction amount that is required for the reference guide 21 to be aligned with the feed direction Y.

The input unit 6 is used by a user for inputting information required for correcting the inclination of the reference guide 21. The input unit 6 has, for example, a touch screen.

The input unit 6 is used by the user for inputting a folding pattern and a size of a sheet. In other words, the input unit 6 is used by the user for inputting the folding mechanism(s) to be used of the sheet folding unit 3 and a folding length of the folding mechanism(s). For example, the user operates a button displayed on a display of the touch screen, thereby making it possible to input the folding pattern and the size of the sheet.

The input unit 6 is further used for inputting a folding misalignment amount of the sheet S folded by the sheet folding unit 3. For example, the user operates a button displayed on a display, thereby making it possible to input the folding misalignment amount.

The correction amount is calculated by the control unit 5 based on the folding pattern, the size of the sheet and the folding misalignment amount inputted through the input unit 6. The inclination of the reference guide 21 is then corrected by the adjustment mechanism 4. Hereinafter, details of calculation and correction will be described.

In the embodiment, the folding length is a folding length of the folding mechanism (hereinafter, referred to as "the first folding mechanism") that first folds the sheet S, of the folding mechanisms to be used. The folding misalignment amount is a folding misalignment amount of the sheet S folded by the first folding mechanism. The user inputs the folding pattern and the size (length and width) of the sheet through the input unit 6, and thereby information on the folding length of the first folding mechanism and whether the buckle of the first folding mechanism is positioned on the upper side or the lower side is obtained. Here, as illustrated in FIGS. 13(*a*) to 13(*d*), a folding length $L_2$ is a length to a folding line from a leading end of the sheet S before being folded. In addition, the upper buckle and the lower buckle fold the sheet S in an orientation opposite to each other; this has to be considered for the correction of the inclination.

The input unit 6 displays any one of display screens in FIGS. 8A to 10B on the display depending on the inputted information.

Figure 8A:
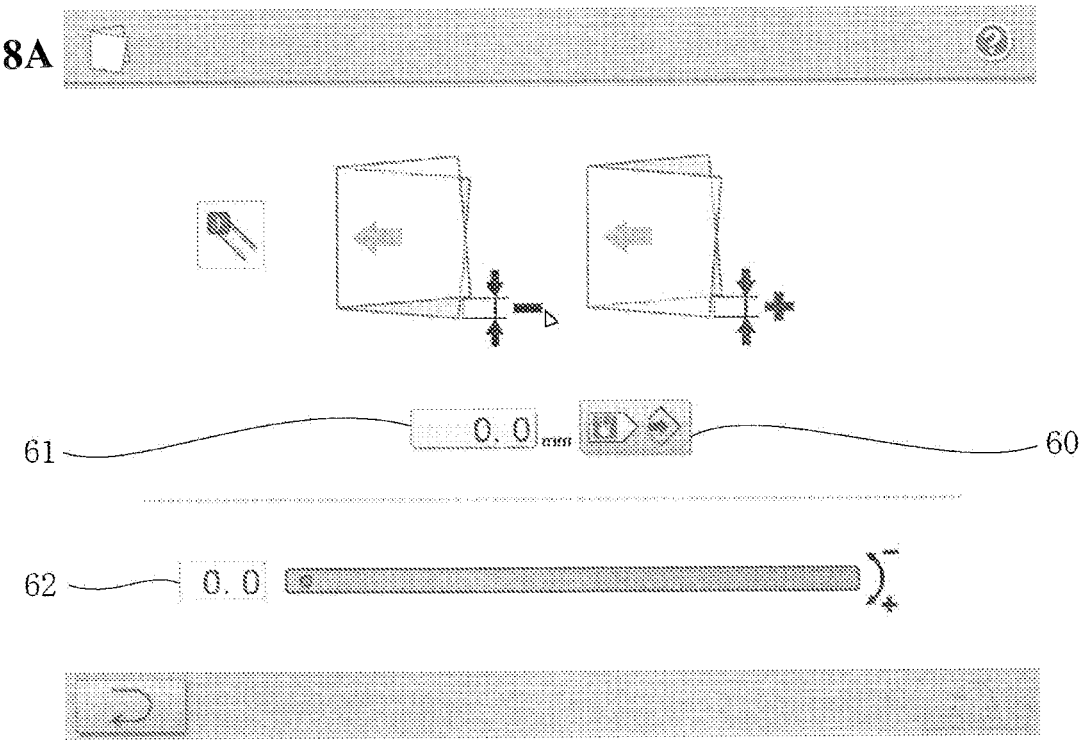
FIGS. 8A and 8B illustrate examples of a display screen of an input unit.
Figure 8B:
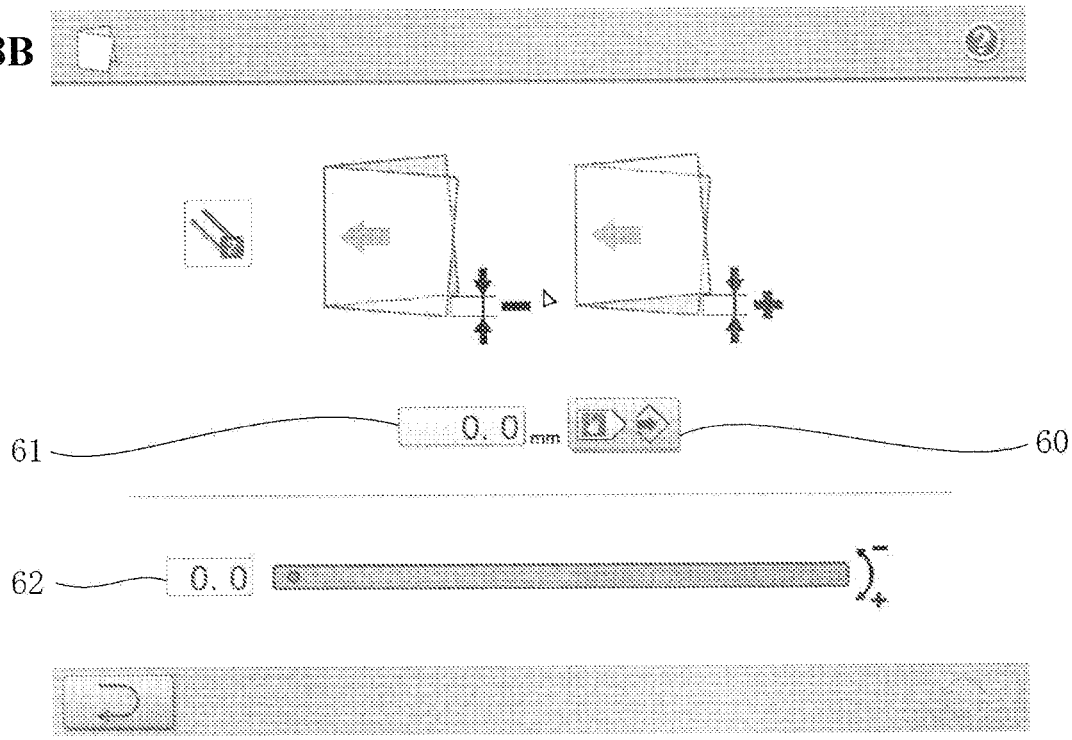

FIG. 8A illustrates a display screen displayed when the folding length is half of a sheet length and the upper buckle 30*a* is used. FIG. 8B illustrates a display screen displayed when the folding length is half of the sheet length and the lower buckle 30*b* is used.

Figure 9A:
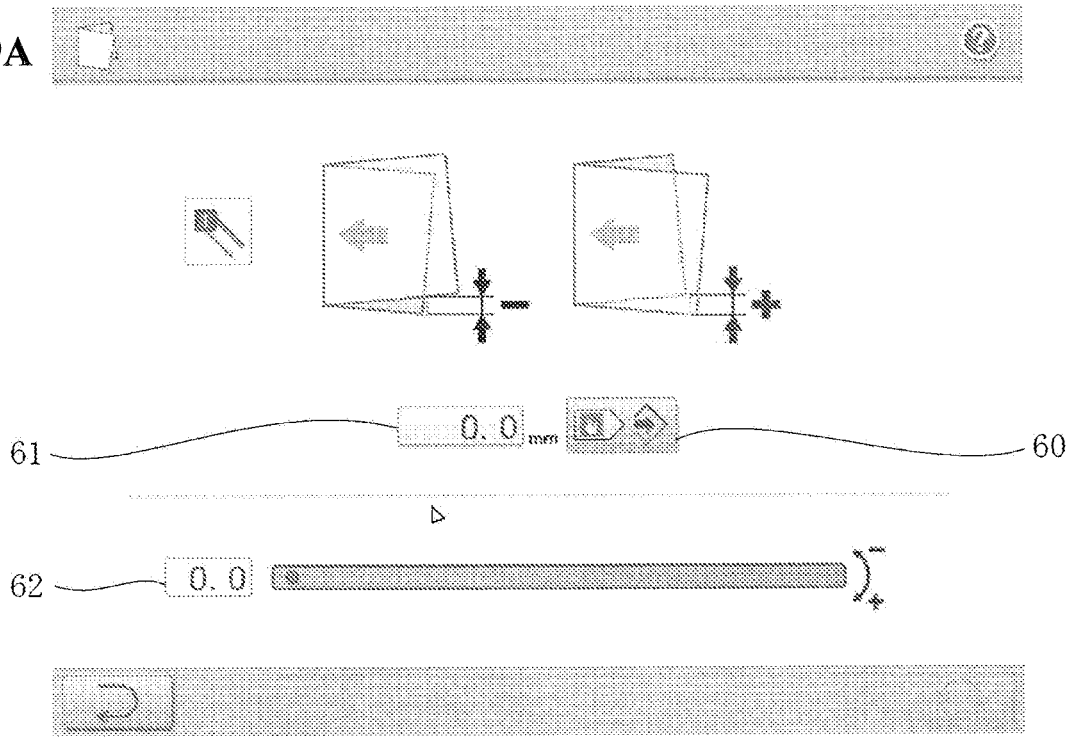
FIGS. 9A and 9B illustrate examples of the display screen of the input unit.
Figure 9B:
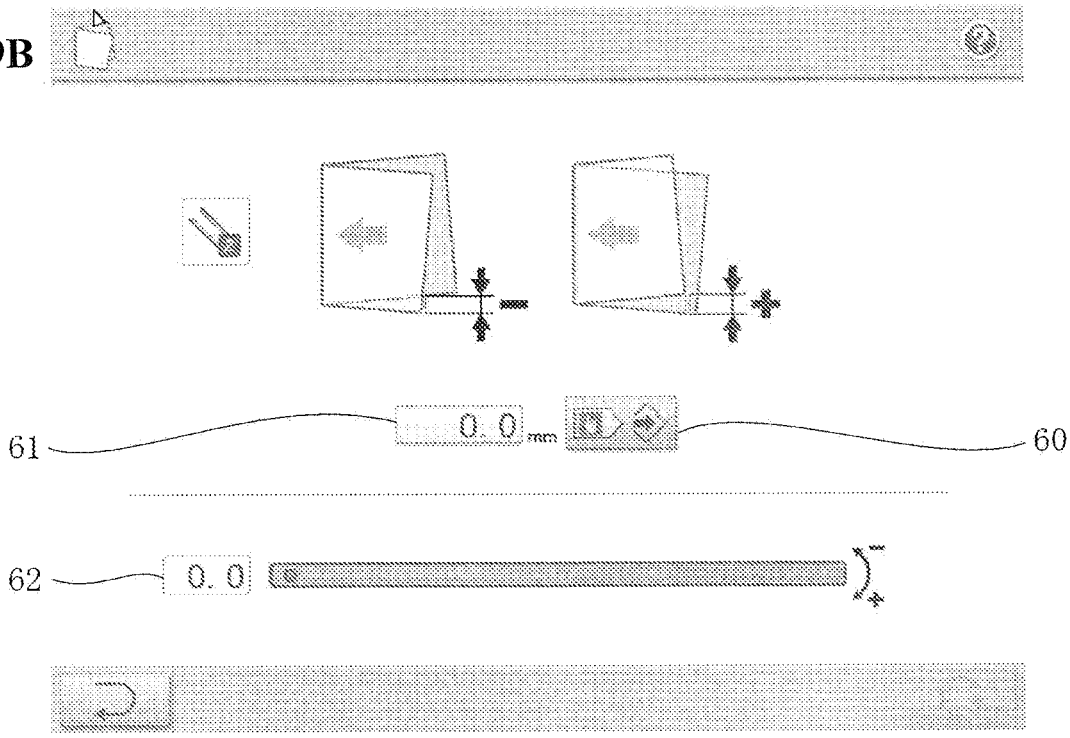

FIG. 9A illustrates a display screen displayed when the folding length is longer than half of the sheet length and the upper buckle is used. FIG. 9B illustrates a display screen displayed when the folding length is longer than half of the sheet length and the lower buckle is used.

Figure 10A:
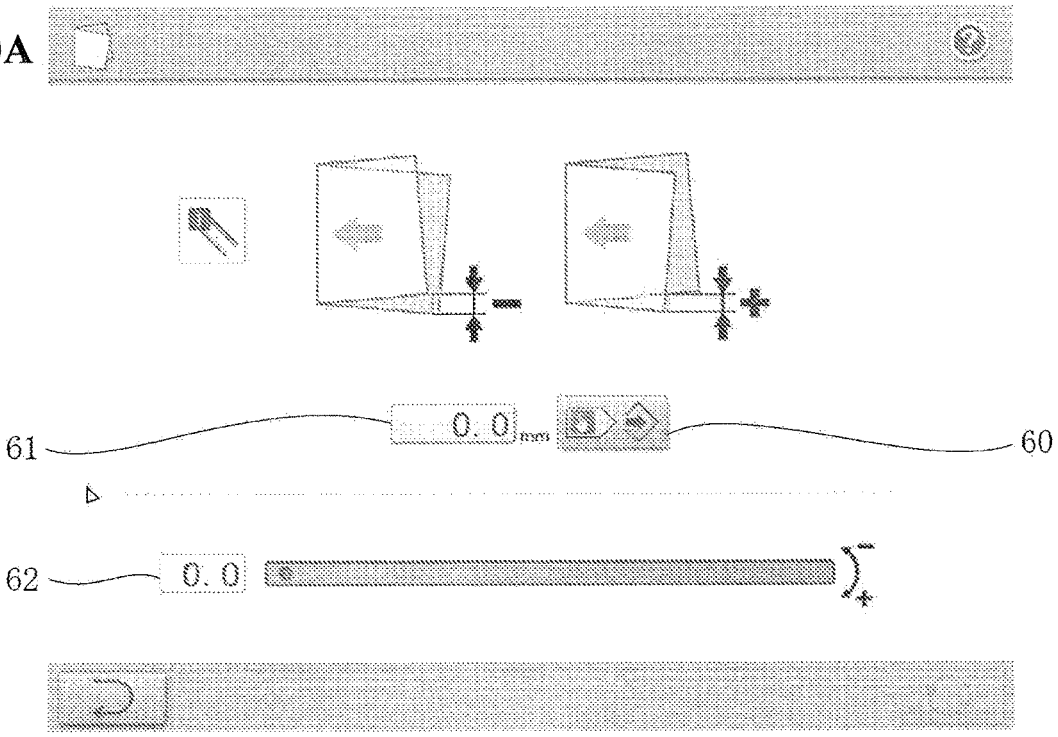
FIGS. 10A and 10B illustrate examples of the display screen of the input unit.
Figure 10B:
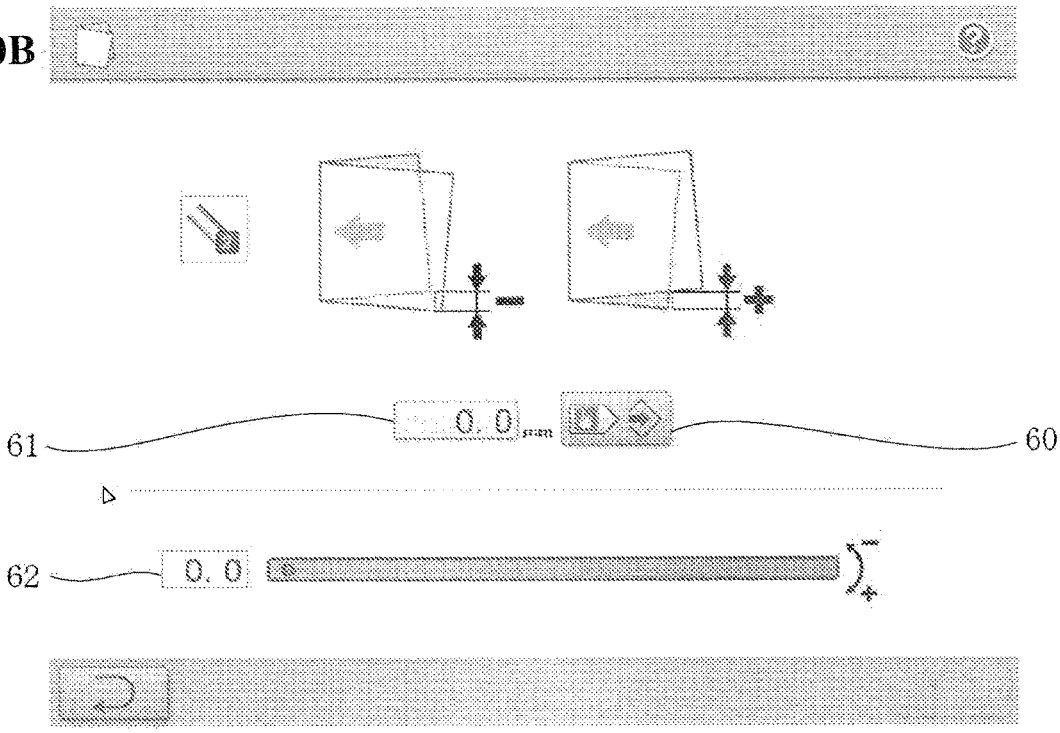

FIG. 10A illustrates a display screen displayed when the folding length is shorter than half of the sheet length and the upper buckle is used. FIG. 10B illustrates a display screen displayed when the folding length is shorter than half of the sheet length and the lower buckle is used.

The drawings of sheets on the respective display screens are plan views of sheets in a state of being folded only by the first folding mechanism and discharged from the sheet folding unit 3. Left pointing arrows on the respective display screens correspond to the feed direction Y.

Subsequently, the sheet folding apparatus requests an input of the folding misalignment amount to the user. The user inputs the folding misalignment amount of the sheet S folded by the first folding mechanism through the input unit 6. In the embodiment, as illustrated in FIG. 12C, a folding misalignment amount d is defined as a distance from the end of the one side edge Sa (that abutted the reference guide 21) of the folded sheet S to the one side edge Sa along the folding line.

Accordingly, the user causes the sheet folding apparatus to fold the sheet S as a trial, and then measures the folding misalignment amount of the sheet S folded by the first sheet folding mechanism. In the ease where the sheet S is folded a plurality of times, the user measures the folding misalignment amount after the user unfolds folding formed by a folding mechanism(s) other than the first folding mechanism.

Figure 11:
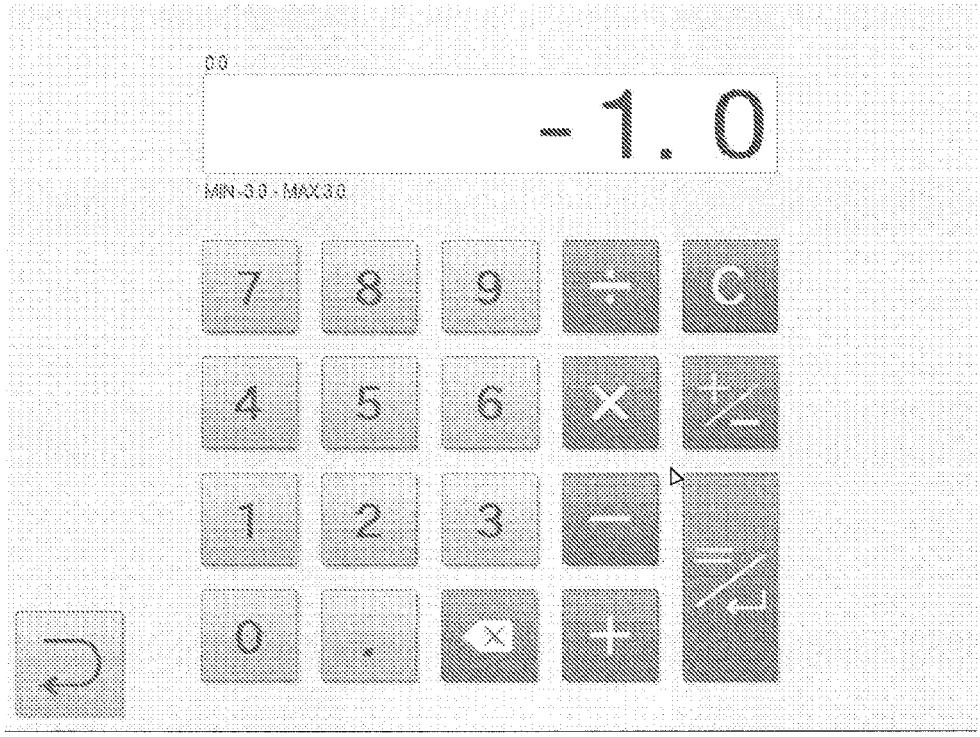
FIG. 11 illustrates an example of the display screen of the input unit.

When the user operates an input button 60 of the display screen, an input screen in FIG. 11 is displayed. The user inputs the measured folding misalignment amount on the input screen. As seen from FIGS. 8A to 10B, a direction of misalignment of sheet S changes depending on a direction of the inclination of the reference guide 21. In the embodiment, a folding misalignment amount in one direction is requested to be inputted as a minus amount, whereas a folding misalignment amount in the other direction is requested to be inputted as a plus amount. The inputted folding misalignment amount is displayed in a misalignment amount display frame 61.

Figure 12B:
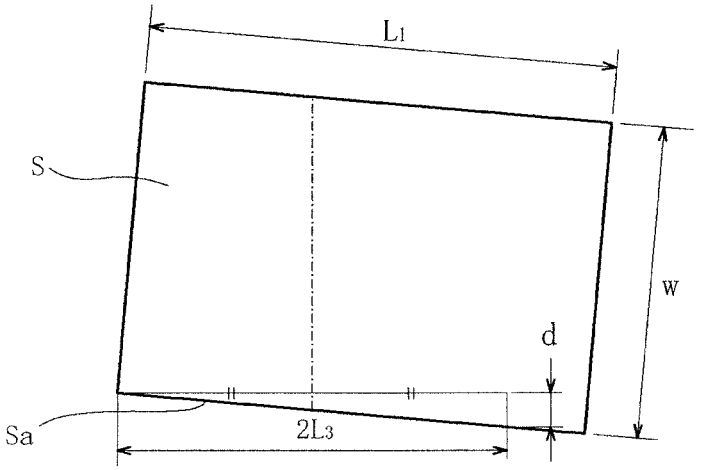
Figure 12C:
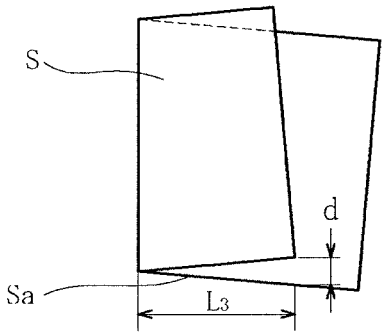
Figure 13A:
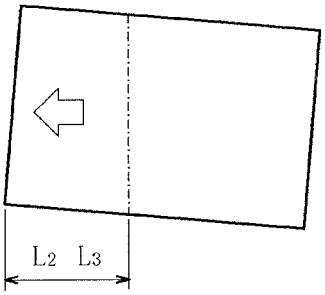
FIGS. 13(*a*) to 13(*d*) are illustration diagrams for describing correction of an inclination of the reference guide.
Figure 13B:
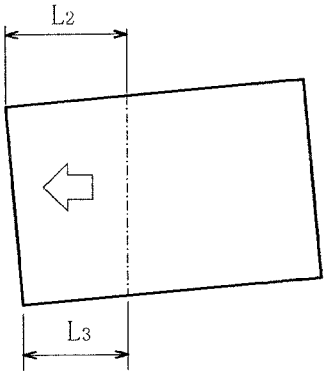
Figure 13C:
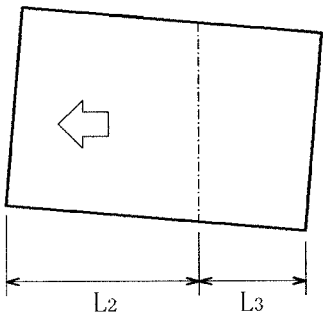
Figure 13D:
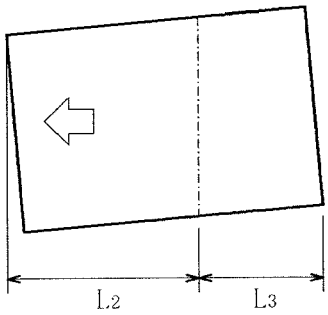

With reference to FIGS. 12 and 13, the control unit 5 then calculates an inclined angle θ [rad] of the reference guide 21 with respect to the feed direction Y based on the folding misalignment amount d [mm], a size (a length $L_1$ [mm] and a width w [mm]) of a sheet, and a folding length $L_2$ [mm] of the sheet folding unit 3 (first folding mechanism), thereby calculating a correction amount <a> [mm] as follows. Hereinafter, the folding misalignment amount d is set as a positive value regardless of the direction of the misalignment of the sheet S (d>0). The angle θ is set as a positive value regardless of the direction of the inclination of the reference guide 21 (0<θπ/2).

Overlapping types of the folded sheet S are classified into four patterns of FIGS. 13(*a*) to 13(*d*) depending on the length $L_1$ of the sheet, the folding length $L_2$, and the direction of the inclination of the reference guide 21.

A relationship of Expression 1 is satisfied in each of FIGS. 13(*a*) to 13(*d*). Here, $L_3$ represents a length of an overlapping portion through the folding (see FIGS. 13(*a*) to 13(*d*)).

[Expression 1]

$$L_3=L_2 \quad \text{(a)}$$

$$L_3=L_2-w\sin\theta \quad \text{(b)}$$

$$L_3=L_1\cos\theta-L_2 \quad \text{(c)}$$

$$L_3=L_1\cos\theta+w\sin\theta-L_2 \quad \text{(d)}$$

Expression 1 can be transformed as the following Expression 2.

[Expression 2]

$$\theta=\tan^{-1}\frac{d}{2L_3}=\tan^{-1}\frac{d}{2L_2} \quad \text{(a)}$$

$$\theta=\tan^{-1}\frac{d}{2L_3}=\tan^{-1}\frac{d}{2(L_2-w\sin\theta)} \quad \text{(b)}$$

$$\theta=\tan^{-1}\frac{d}{2L_3}=\tan^{-1}\frac{d}{2(L_1\cos\theta-L_2)} \quad \text{(c)}$$

$$\theta=\tan^{-1}\frac{d}{2L_3}=\tan^{-1}\frac{d}{2(L_i\cos\theta+w\sin\theta-L_2)} \quad \text{(d)}$$

In an actual sheet folding apparatus, the angle θ of an inclination of the reference guide 21 is very small. Approximations of Expression 3 may therefore be made.

[Expression 3]

$$\sin\theta\approx\tan\theta\theta$$

$$\cos\theta\approx1$$

Expression 4 is obtained from Expressions 2 and 3.

[Expression 4]

$$\theta=\frac{d}{2L_2} \quad \text{(a)}$$

$$\theta=\frac{d}{2(L_2-w\theta)} \quad \text{(b)}$$

$$\theta=\frac{d}{2(L_1-L_2)} \quad \text{(c)}$$

$$\theta=\frac{d}{2(L_1+w\theta-L_2)} \quad \text{(d)}$$

Since $L_1$, $L_2$, and d are already known, it is possible to obtain the angle θ by (a) and (c) of Expression 4 in the cases of FIGS. 13(*a*) and 13(*c*). (b) and (d) of Expression 4 can be transformed as Expression 5.

[Expression 5]

$$w\theta - L_2\theta + \frac{d}{2} = 0 \quad \text{(b)}$$

$$w\theta^2 + (L_1 - L_2)\theta - \frac{d}{2} = 0 \quad \text{(d)}$$

The expressions are quadratic equations of θ. When an obviously different solution of the two obtained solutions is excluded, the angle θ can be obtained by (b) and (d) of Expression 6 in the cases of FIGS. 13(*b*) and 13(*d*).

[Expression 6]

$$\theta = \frac{L_2 - \sqrt{L_2^2 - 2wd}}{2w} \quad \text{(b)}$$

$$\theta = \frac{-(L_1 - L_2) + \sqrt{(L_1 - L_2)^2 + 2wd}}{2w} \quad \text{(d)}$$

The correction amount <a> can be obtained by Expression 7. As illustrated in FIG. 12A, $L_0$ is a distance from a fulcrum (pin 24) of the reference guide 21 to a point of action at which the adjustment mechanism 4 exerts a force on the reference guide 21, $L_0$ is already known.

[Expression 7]

$$a = L_0\theta$$

The control unit 5 identifies the corresponding pattern from the patterns of FIGS. 13(*a*) to 13(*d*) based on the input information and calculates the angle θ by the computational expression described above which corresponds to the identified pattern, thereby calculating the correction amount <a>. The adjustment mechanism 4 is controlled by the control unit 5 in such a manner that the adjustment mechanism 4 rotates the reference guide 21 by the correction amount <a> in an appropriate direction, thereby correcting the inclination of the reference guide 21 with respect to the feed direction Y. The rotating direction 21 of the reference guide is determined depending on the direction of the misalignment of the sheet (i.e. plus or minus of the folding misalignment amount) and the upper or lower buckle (regarding the rotating direction, see each of FIGS. 8A to 10B). As illustrated in FIGS. 8A to 10B, the calculated correction amount <a> is displayed in a correction amount display frame 62 of the display screen.

As a result of the correction of the inclination, the reference guide 21 extends in parallel with the feed direction Y, which means it is aligned with the feed direction Y. In other words, the reference guide 21 extends orthogonally to the fold direction. Therefore, the skew of the sheet S is accurately corrected with respect to the feed direction Y, and the sheet S is fold by the sheet folding unit 3 without any misalignment.

As described above, the user only inputs the folding misalignment amount d of the sheet S folded by the sheet folding unit 3, through the input unit 6, thereby making it possible to accurately correct the inclination of the reference guide 21. It is, therefore, possible to correct the inclination of the reference guide 21 with ease and in a short time.

The preferred embodiment of the invention is described, however the invention is not limited to the embodiment described above.

The folding pattern and the size of the sheet may be obtained from a device disposed outside the sheet folding apparatus (e.g. a pre-processing device disposed upstream of the sheet folding apparatus), instead of being inputted by a user through the input unit 6.

The sheet folding unit 3 may have a configuration other than that of the buckle folding machine. The adjustment mechanism 4 may adjust the inclination of the reference guide 21 by another configuration.

In the embodiment described above, calculation of the angle θ of (b) and (d) of Expression 5 is relatively complicated, and thus a heavy load is applied to the control unit 5. In order to reduce the load, the control unit 5 may calculate the angle θ by (a) of Expression 4 in the case of FIG. 13(*b*) and calculate the angle θ by (c) of Expression 4 in the case of FIG. 13(*d*), and thereby the calculation may be simplified. Even in this case, it is empirically understood that there is no problem in practical use.

Figure 14:
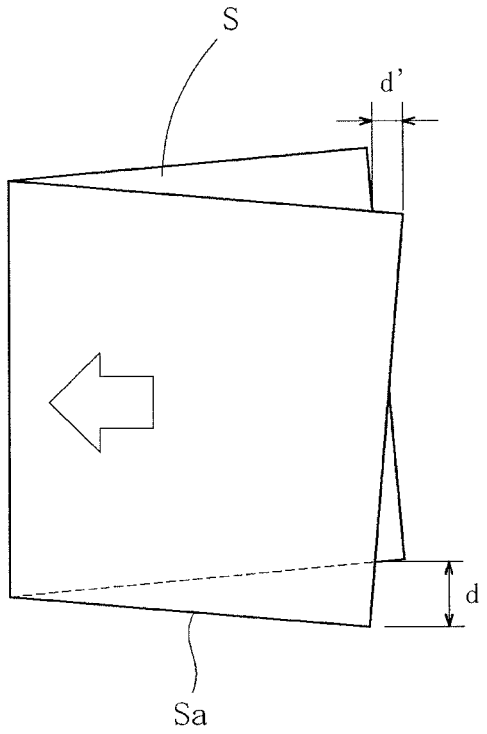
FIG. 14 is an illustration diagram for describing a folding misalignment amount of a sheet.

As long as it is possible to calculate the correction amount <a>, the folding misalignment amount may be optionally defined. For example, as illustrated in FIG. 14, instead of the folding misalignment amount d, a different folding misalignment amount d' may be defined, and the control unit 5 may calculate the angle θ and the correction amount <a> by using the folding misalignment amount d' and at least one appropriate arithmetic expression.

EXPLANATIONS OF LETTERS OR NUMERALS

1 SHEET FEED UNIT
2 CONVEYANCE UNIT
21 REFERENCE GUIDE
22 CONVEYANCE MECHANISM
24 PIN
3 SHEET FOLDING UNIT
4 ADJUSTMENT MECHANISM
5 CONTROL UNIT
6 INPUT UNIT
d, d' FOLDING MISALIGNMENT AMOUNT
$L_1$ LENGTH OF SHEET
$L_2$ FOLDING LENGTH
w WIDTH OF SHEET
Y FEED DIRECTION

The invention claimed is:

1. A sheet folding apparatus comprising:

a sheet folding unit disposed to fold a sheet; and a conveyance unit disposed to feed the sheet to the sheet folding unit in a feed direction orthogonal to a fold direction of the sheet folding unit while correcting a skew of the sheet, the conveyance unit including:

an elongated reference guide;

a conveyance mechanism disposed to convey the sheet in the feed direction while exerting a force on the sheet toward the reference guide, the skew of the sheet being corrected by the reference guide and the conveyance mechanism; and an adjustment mechanism disposed to adjust an inclination of the reference guide with respect to the feed direction, the sheet folding apparatus further comprising:

an input unit through which a user inputs a folding misalignment amount of the sheet folded by the sheet folding unit, the inclination of the reference guide being corrected by the adjustment mechanism based on at least the folding misalignment amount inputted through the input unit.

2. The sheet folding apparatus according to claim 1,
wherein the input unit is further used by the user for inputting a folding pattern of the sheet, and
wherein the inclination of the reference guide is corrected based on at least the folding misalignment amount and the folding pattern inputted through the input unit.

3. The sheet folding apparatus according to claim 1,
wherein the input unit is further used by the user for inputting a size of a sheet to be folded, and
wherein the inclination of the reference guide is corrected based on at least the folding misalignment amount and the size inputted through the input unit.

4. The sheet folding apparatus according to claim 1,
wherein a correction amount required for the reference guide to be aligned with the feed direction is calculated based on the folding misalignment amount, a folding length of the sheet folding unit, and a size of a sheet to be folded.

5. The sheet folding apparatus according to claim 4,
wherein the sheet folding unit includes a plurality of folding mechanisms disposed to fold the sheet once in the fold direction,
wherein the folding length is a folding length of the folding mechanism that first folds the sheet, and
wherein the folding misalignment amount is a folding misalignment amount of the sheet folded by the folding mechanism that first folds the sheet.

6. The sheet folding apparatus according to claim 1,
wherein the reference guide is disposed to be rotatable around a pin extending in a vertical direction, and
wherein the adjustment mechanism adjusts the inclination of the reference guide by rotating the reference guide around the pin.

7. The sheet folding apparatus according to claim 1,
wherein the sheet folding unit is a buckle folding machine.

* * * * *